US006786276B2

(12) United States Patent
Samy et al.

(10) Patent No.: US 6,786,276 B2
(45) Date of Patent: Sep. 7, 2004

(54) HEAT EXCHANGER TUBE WITH OPTIMIZED PLATES

(75) Inventors: Patrick Samy, Le Mans (FR); Sylvain Moreau, Spay (FR); Frédéric Bousquet, La Suze/Sarthe (FR)

(73) Assignee: Valeo Climatisation, La Verriere (FR)

( * ) Notice: Subject to any disclaimer, the term of this patent is extended or adjusted under 35 U.S.C. 154(b) by 24 days.

(21) Appl. No.: 10/278,841

(22) Filed: Oct. 24, 2002

(65) Prior Publication Data

US 2003/0079871 A1 May 1, 2003

(30) Foreign Application Priority Data

Oct. 31, 2001 (FR) ..... 01 14185

(51) Int. Cl.[7] ..... F28D 1/02; F28F 13/12; F28F 9/02

(52) U.S. Cl. ..... 165/174; 165/167; 165/109.1; 165/153

(58) Field of Search ..... 165/153, 174, 165/176, 167, 166, 906, 109.1; 62/515

(56) References Cited

U.S. PATENT DOCUMENTS 4,696,342 A * 9/1987 Yamauchi et al. ..... 165/906
4,915,163 A * 4/1990 Matsunaga et al. ..... 165/153
5,042,577 A * 8/1991 Suzumura ..... 165/153
5,137,082 A 8/1992 Shimoya et al.
5,409,056 A * 4/1995 Farry et al. ..... 165/153
5,669,439 A * 9/1997 Hasegawa et al. ..... 165/153
5,735,343 A 4/1998 Kajikawa et al.
5,984,000 A * 11/1999 Nakamura et al. ..... 165/153

FOREIGN PATENT DOCUMENTS

| | | | |
|---|---|---|---|
| DE | 100 33 965 A1 | | 3/2001 |
| JP | 01 244282 A | | 9/1989 |
| JP | 406066487 A | * | 3/1994 |
| JP | 408291989 A | * | 11/1996 |
| JP | 2000 146477 A | | 5/2000 |
| WO | WO 97/37187 | | 10/1997 |
| WO | WO00/16029 | | 3/2000 |

* cited by examiner

*Primary Examiner*—Henry Bennett
*Assistant Examiner*—Tho v Duong
(74) *Attorney, Agent, or Firm*—Ronald Courtney

(57) ABSTRACT

The invention relates to tubes for heat exchangers through which a fluid flows, intended to promote heat exchange between an external medium and said fluid, formed by at least two plates connected to each other in order to define a circulation duct. The tube comprises a means for partially blocking the circulation duct intended to keep the passage cross section of said duct substantially constant between an inlet orifice and an outlet orifice.

The heat exchangers have plate based tubes and are used especially as an evaporator in an air conditioning system or radiator in the cooling circuit of a vehicle.

28 Claims, 5 Drawing Sheets

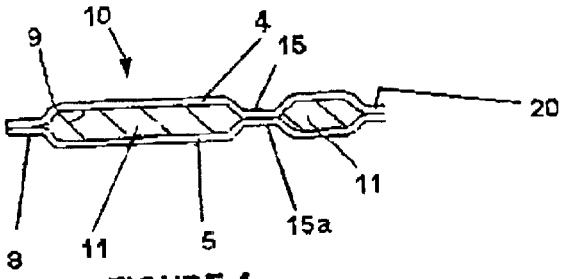
FIGURE 4
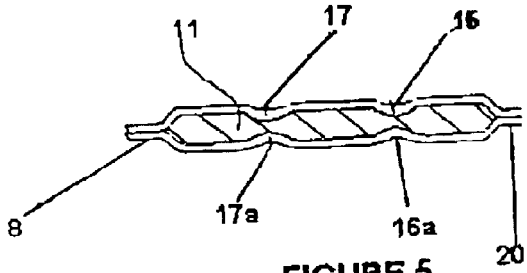
FIGURE 5
FIGURE 6
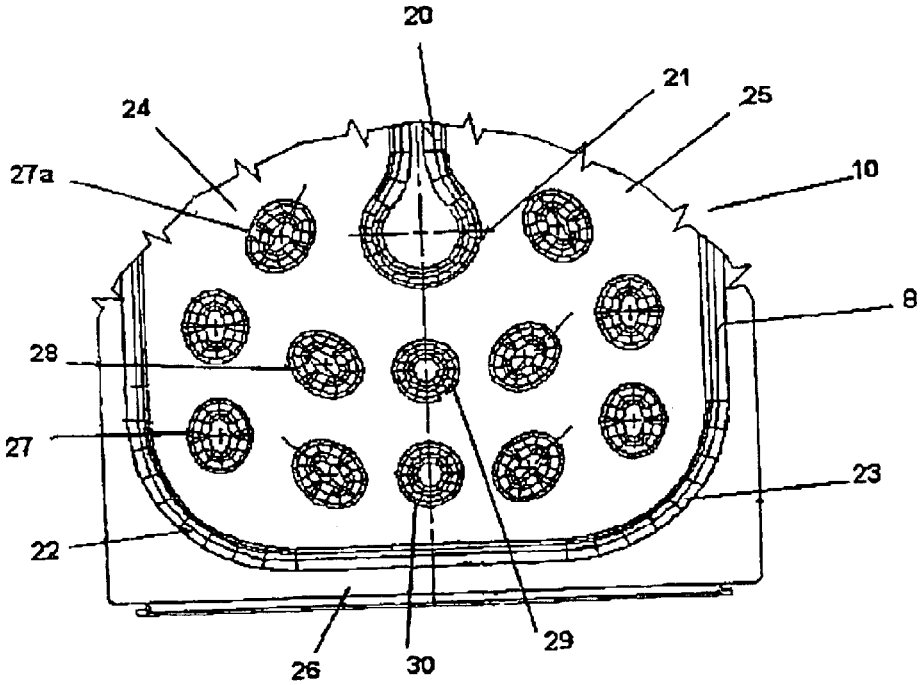

HEAT EXCHANGER TUBE WITH OPTIMIZED PLATES

BACKGROUND OF THE INVENTION

The technical field of the present invention is that of heat exchangers and, more particularly, of plate-based tubes with flow disturbers which equip them. These exchangers are used especially as an evaporator in an air-conditioning system in an automobile or as a radiator in the cooling circuit of such a vehicle.

Heat exchangers, called plate exchangers, in the shape of an I or a U, generally consist of the assembly of several flat tubes juxtaposed with each other and connected together by a separator, the aim of which is to promote heat exchange. Each of these tubes is formed by the face-to-face assembly of two plates which thus define a circulation duct into which the fluid flows. This fluid may be a refrigerant in the case of an evaporator or a coolant in the case of a radiator.

DESCRIPTION OF THE PRIOR ART

It is known from the prior art to place flow disturbers in the fluid circulation duct. These flow disturbers are very often an integral part of the plates forming the tube. The aim of these flow disturbers is to create turbulence on passage of the fluid so as, on the one hand, to increase the heat exchange between the fluid and the plates and, on the other hand, to provide mechanical integrity of the tube bundle of the exchanger.

One of the main drawbacks of this configuration is the creation of acoustic noise due to overspeed of the fluid, noise which it is increasingly important to overcome, given the increasing level of comfort demanded within a vehicle.

Another drawback of this type of assembly lies in the fact that it does not offer very good circulation performance or optimum efficiency given the virtually uncontrolled arrangement of the flow disturbers in the prior art.

SUMMARY OF THE INVENTION

The aim of the present invention is therefore to solve the drawbacks described above mainly by placing the flow disturbers on the plates so as to maintain a substantially constant passage cross section for the fluid in the circuit while keeping the advantages associated with the turbulence created by the latter. This therefore involves optimizing both aspects of decreasing pressure drops and of promoting heat exchange.

The subject of the invention is therefore a tube for a heat exchanger through which a fluid flows, intended to promote heat exchange between an external medium and said fluid, formed by at least two plates connected to each other in order to define a circulation duct, the cross section of which is a cross section for passage of said fluid, said circulation duct having a fluid inlet orifice and a fluid outlet orifice, wherein said tube comprises a means for partially blocking the circulation duct intended to keep the passage cross section of said duct substantially constant between the inlet orifice and the outlet orifice.

According to one characteristic of the invention, the tube has the general shape of a "U" comprising a base connected to two arms, said arms being separated by a rib, the end of which is terminated by a junction, the passage cross section to be kept constant being any one of those which lie between the rib and a peripheral edge of the U-shaped tube and passing through the partial blocking means.

According to another characteristic of the invention, the shape of the junction is circular with a diameter greater than twice the width of the rib.

According to yet another characteristic of the invention, the peripheral edge has connection regions connecting the two arms at the base of the U-shaped tube, said regions being of circular shape and of a radius enabling the passage cross section to be kept constant.

Advantageously, the partial blocking means is defined by the positioning of flow disturbers each with respect to the others such that their cumulated blocking cross sections are substantially constant over the entire length of the circulation duct.

The passage cross section is constant when the difference between a minimum passage cross section and a maximum passage cross section determined in the circulation duct does not exceed 20 percent. This blocking means is also defined by the shape of the flow disturbers each with respect to the others in the circulation duct.

Advantageously again, the flow disturbers are placed on at least one of the plates.

Similarly, the flow disturbers are placed on at least one of the plates such that the direction of the axis supporting their largest dimensions is substantially parallel to the circulation direction of the fluid.

According to one variant of the invention, the flow disturbers are present on both plates.

According to another variant of the invention, at least one flow disturber of one of the plates is placed facing at least one flow disturber of the other plate.

The flow disturbers of each plate are placed facing each other, the directions of their axes supporting their largest dimensions being substantially parallel to each other.

According to one characteristic of the invention, the plates are securely attached by the flow disturbers.

According to another characteristic of the invention, the flow disturbers have an oval shape or a circular shape.

According to yet another characteristic of the invention, the flow disturbers have the shape of a diamond, advantageously with rounded angles.

The flow disturbers have a pyramid shape, the base of the pyramid shape being common with one of the plates. Advantageously, a heat exchanger comprises at least one tube defined according to any one of the preceding characteristics.

The heat exchanger is a radiator or an evaporator.

A very first advantage of the device according to the invention lies in the reduction of sound noise of this type of exchanger.

Another advantage lies in the optimization of the combination of efficiency together with the sound noise.

Another advantage of the invention lies in the possibility of optimizing the internal pressure drop in the tube.

Another advantage is the improvement of the combination of the efficiency characteristics together with the mechanical integrity.

DESCRIPTION OF THE DRAWINGS

Other characteristics, details and advantages of the invention will emerge more clearly on reading the description given below by way of example in relation to the drawings in which:

FIGS. 4, 5, 7, 8 and 9 are views in cross section of the heat exchanger tube along A—A, B—B, C—C, D—D and E—E, respectively, illustrating the constancy of the passage cross sections throughout the circulation duct, FIG. 6 is a front face of a plate more particularly highlighting the U-shaped base.

DETAILED DESCRIPTION OF THE INVENTION

Figure 1:
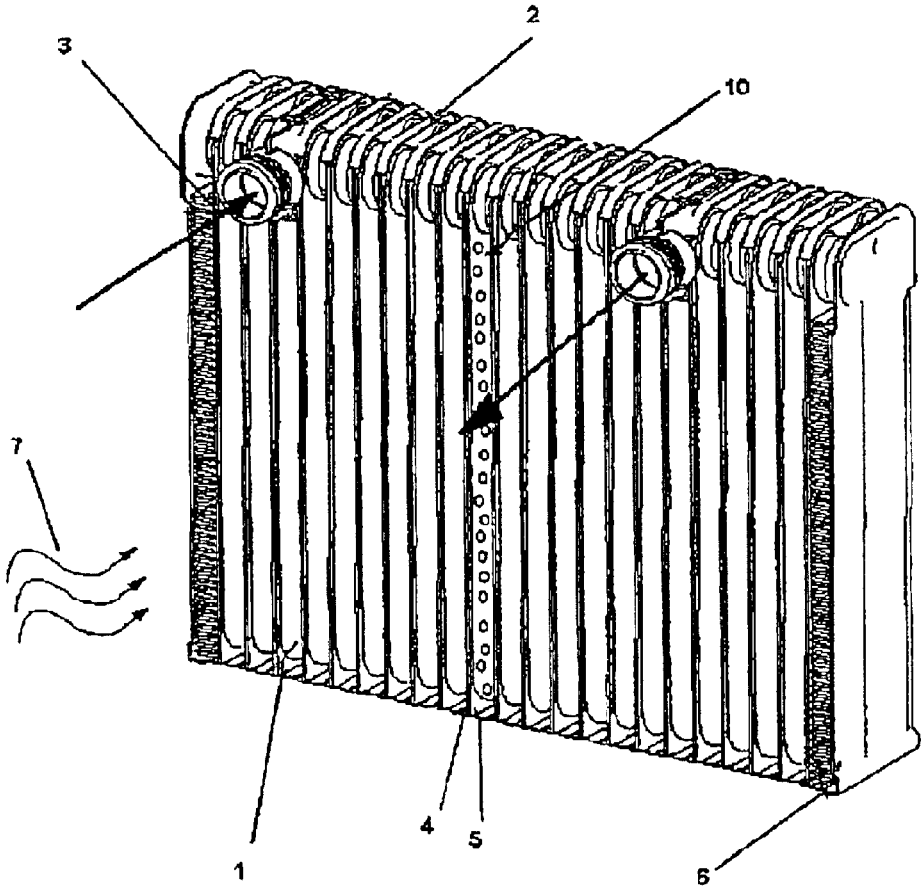
FIG. 1 is a perspective view of a heat exchanger using the tube according to the invention.

FIG. 1 illustrates the use which can be made of a tube 1 according to the invention, in this case mounted in a heat exchanger 2. The latter may be an evaporator, a radiator or a condenser. In the case shown here, it is an evaporator which consists of a multitude of tubes 1. The number of tubes 1 forming the exchanger 2 depends on the heat exchange characteristic required, this number is shown in this figure by way of nonlimiting example. A separator 6 with fins is installed between each tube 1 so as to optimize heat exchange.

The tube 1 is generally formed by two plates 4 and 5 placed against each other. The juxtaposition of several tubes formed in this way makes it possible to build a heat exchanger, the aim of which is to promote the transfer of energy between an internal medium, advantageously a fluid 3, and an external medium 7 which could, for example, be air. Both plates 4 and 5 are in contact with each other on their peripheral edges 8 so as to define, with their internal walls 9, a circulation duct 10. The latter transports the fluid 3 which may, for example, be the coolant in the case of a radiator, or a refrigerant in the case of an evaporator or a condenser. This duct 10 is characterized by a passage cross section 11 which is equivalent to the area filled by the fluid at predetermined locations of the circulation duct. This passage cross section 11 will be illustrated in further detail in the description of FIGS. 4, 5, 7, 8 and 9.

Figure 2:
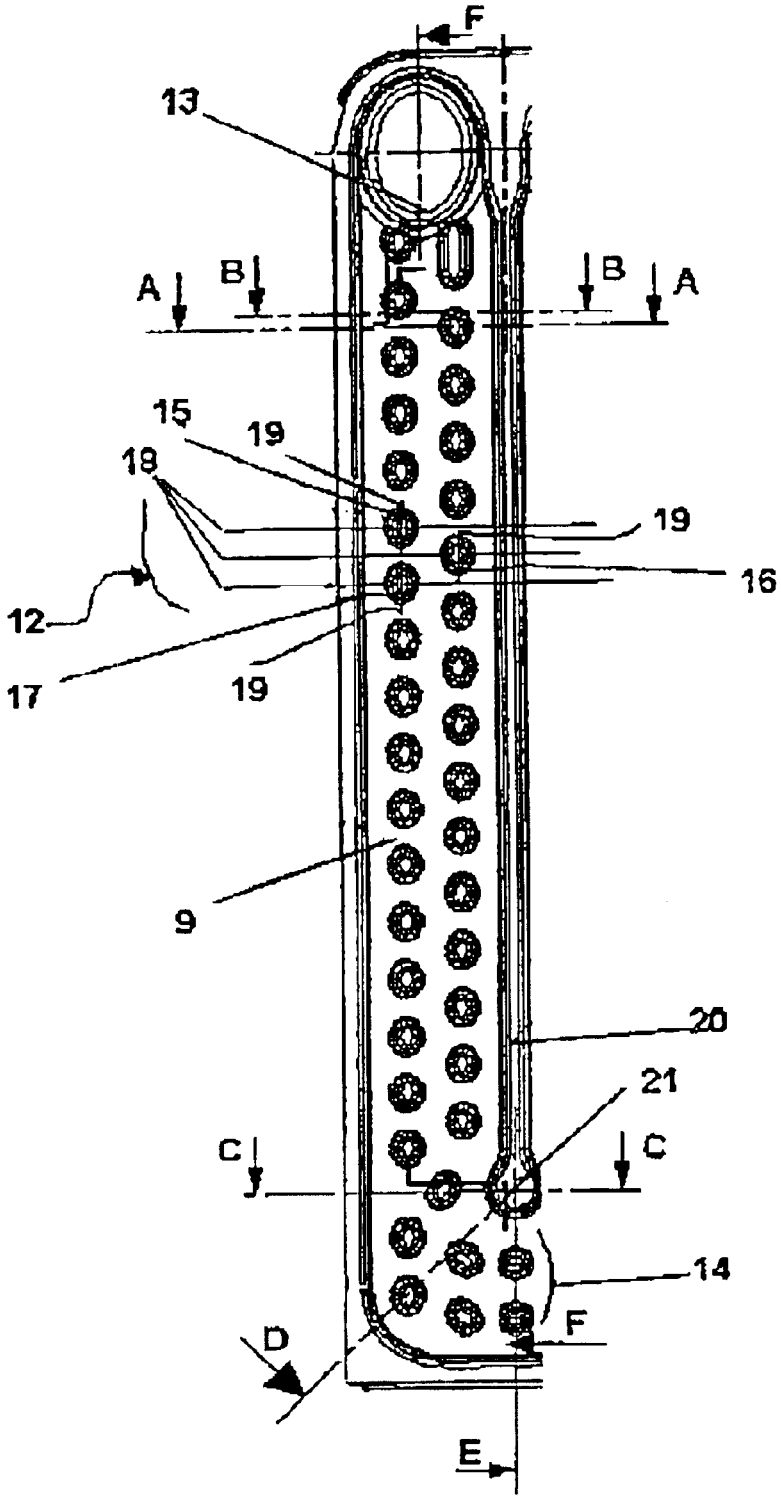
FIG. 2 is a partial front view of one of the U-shaped plates of the heat exchanger tube according to the invention.

More specifically, FIG. 2 shows a plate of the tube 1 of the heat exchanger 2. This tube comprises a means 12 of partially blocking the circulation duct 10 so as to keep the passage cross section 11 constant throughout the circuit which extends from an inlet orifice 13 for the fluid 3 to an outlet orifice 14 for said fluid.

This figure emphasizes the construction of the partial blocking means 12. The plate 4 seen from the front makes it possible to highlight the position of the flow disturbers 15, 16, 17 each with respect to the other and their possible shapes. An axis 18 is shown for each flow disturber illustrating the position of the flow disturber in a horizontal plane and an axis 19 for each flow disturber illustrating its position in a vertical plane. The careful combination of positioning both flow disturbers, for example 15 and 16, in a vertical plane and in a horizontal plane therefore makes it possible for the partial blocking means 12 thus formed to keep the passage cross section 11 constant. The position of these flow disturbers is such that they are staggered, that is to say that the axes 18 of the flow disturbers are offset, possibly by a constant pitch, along a vertical axis in the circulation direction of the fluid. These flow disturbers may have any suitable shape capable of limiting the speed of a fluid. In particular, the latter may have a generally oval, circular or diamond shape or a diamond shape rounded at its angles. These flow disturbers are manufactured, for example, by stamping and may have, inter alia, a pyramid shape. The base of the pyramid shape of the flow disturbers is common to the plate 4 or 5, in particular along its internal wall 9.

Figure 3:
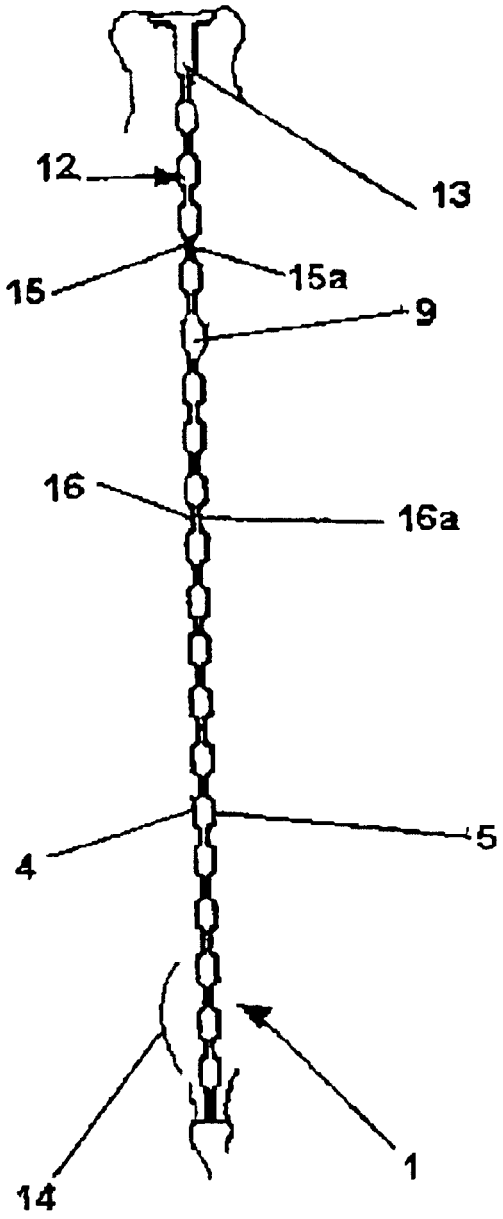
FIG. 3 is a view in longitudinal section along F—F illustrating both plates of the heat exchanger tube according to the invention.

FIG. 3 is a view along section F—F of FIG. 2 illustrating a tube 1 according to the invention. The two plates 4 and 5 forming this tube are placed face to face. In this figure, it is possible to see that the flow disturber 15, present on the plate 4, faces another flow disturber 15*a* present on the plate 5. These two flow disturbers are in contact inside the circulation duct 10 and may therefore be involved in the mechanical connection which connects the two plates 4 and 5. That is to say that both the latter may be securely attached to each other, for example by welding or brazing, thus strengthening the structure of the tube 1.

Of course, these flow disturbers may be completely facing one another such that their axes 18 and 19 are coincident, but they could also be only partially facing each other along the axis 18 or 19 or a combination of both (not shown).

The flow disturbers 16 and 16*a*, shown on the plates 4 and 5, respectively, have a particular feature with respect to the previous ones in the sense that their ends do not touch.

In any case, the combination of the positioning characteristics and flow disturber shapes described above together with the distance which separates at least one of their ends from the opposite wall is a function of the level of acoustic efficiency required in the heat exchanger 2. This efficiency is dependent on the speed of the fluid 3 inside the tube 1, a speed which is made substantially constant by the partial blocking means 12.

FIGS. 4 and 5 are illustrations of the constancy of the passage cross section 11 throughout the path followed by the fluid 3 in the circulation duct 10 of a tube 1 having the general shape of an I or in the straight parts of a U-shaped tube. The term constant cross section refers to a difference of about 20% between a minimum cross section and a maximum cross section taken at any location of the tube.

FIG. 4 illustrates one of these cross sections 11 which can be seen through a section A—A made on FIG. 2. The two plates 4 and 5, joined along their peripheral edges 8, are shown therein. The circulation duct 10 in this case is delimited by this peripheral edge 8, the internal walls 9 of both plates 4 and 5, the shape of the flow disturbers 15 and 15*a* and, in the case of a U-shaped tube 1, by a rib 20. This figure shows, by way of illustration, two flow disturbers 15 and 15*a* placed face to face, their ends being in contact. The passage cross section 11 is shown in the figure by the hatched part.

FIG. 5 retains the common elements already referenced in the description of FIG. 4. On the other hand, the section taken along B—B in FIG. 2 illustrates the gradual change to pyramid of the flow disturbers 15, 15*a* and 17, 17*a*. Although, in FIG. 4, the blocking was caused by two flow disturbers in contact, in this case there are four flow disturbers either of less depth, or of pyramidal shape.

The sum of the blocking cross section of a flow disturber 15 and the blocking cross section of the neighboring flow disturber or disturbers 15*a*, 16, 16*a*, 17, 17*a* must be substantially constant. The term blocking cross section refers to the volume taken up by a flow disturber within the circulation duct 10, a volume which limits the passage of the fluid 3. This sum, substracted from the total cross section of the circulation duct 10 is then constant whatever the location at which a section is taken between the inlet orifice 13 and the outlet orifice 14. In the case shown in this figure, the cross section 11 for passage of the fluid is illustrated by the hatched part.

FIG. 6 is particular to a U-shaped tube 1. This shape has two arms 24 and 25 connected together by a base 26. Thus a circulation duct 10 is formed, the inlet orifice 13 and the outlet orifice 14 of which are virtually aligned. Thus the arm 24 of the U is separated from the arm 25 by a rib 20. The circulation duct 10 is then delimited by the peripheral edge 8, the internal walls 9 of the two plates 4 and 5, the shape of the flow disturbers and by the rib 20. The latter is terminated at the base 26 by a junction which is advantageously circular. The diameter of this circular junction 21 is greater than twice the width of the rib 20. At the transition between the base 26 and the arms 24 and 25, the circulation duct 10 is limited by the peripheral edge 8, the latter has a particular shape illustrated by two connection regions 22 and 23 of generally circular shape and of a radius enabling a constant cross section to be retained. The junction 21, the flow disturbers and the connection regions 22 and 23 are part of the partial blocking means 12. Their combinations of shapes, positions and dimensions contribute to keeping the passage cross section 11 substantially constant in the lower part of the U-shaped tube 1. The orientation of the flow disturbers is arranged so that their cumulated cross sections are constant and therefore, indirectly, the passage cross section of the circulation duct 10, in spite of the particular nature of this region of the U-shaped tube. Specifically, in this case, some flow disturbers, for example 27 and 27*a*, may have an axis supporting their greatest dimensions which is not parallel to the axis of the fluid circulation.

Figure 7:
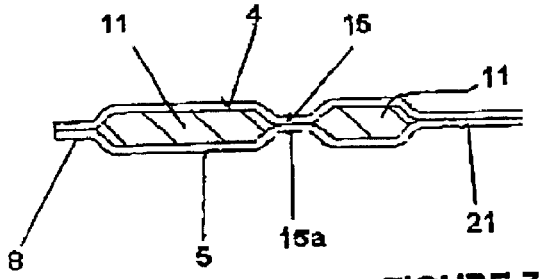

FIG. 7 is a representation retaining the references of the common elements described in FIGS. 4 and 5. This figure illustrates a section C—C of FIG. 2 taken virtually horizontally at the height of the junction 21. The radius of this junction 21, the position and/or the shape of the flow disturber or disturbers creates a blocking cross section which will limit the speed of the fluid in this part of the circulation duct 10. The passage cross section 11 in this part of the duct is illustrated by hatching.

Figure 8:
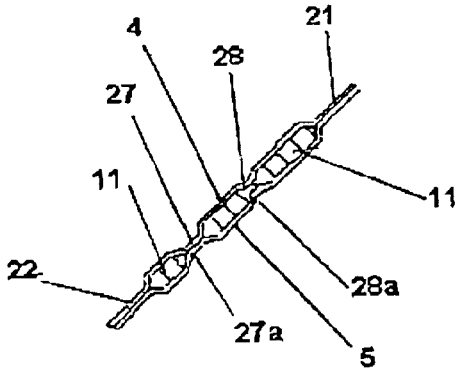

FIG. 8 shows a passage cross section 11 along a cross section D—D of FIG. 2. This cross section is blocked by the combination of dimensional characteristics of the junction 21, of the connection region 22 and of the flow disturbers 27, 27*a* and 28, 28*a*. The flow disturbers 27 and 27*a* have their ends in contact so as to create a maximum blocking cross section. On the other hand, the flow disturbers 28 and 28*a* have a smaller depth or are of pyramidal shape and the blocking cross section is therefore decreased. The sum of the blocking cross sections of the flow disturbers 27, 27*a*, 28, 28*a*, junctions 21 and connection regions 22 tends to keep the passage cross section 11 substantially constant. The latter is illustrated in this figure by a hatched region.

Figure 9:
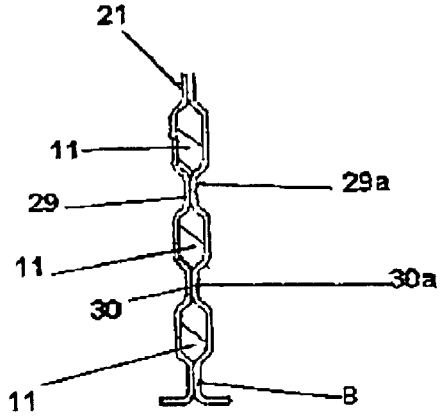

FIG. 9 is a variation in the arrangement and shape of the flow disturbers 30, 30*a* and 29, 29*a*. Specifically, in this vertical section along E—E, the flow disturbers take a circular shape which is particularly suitable for this part of the circulation duct 10. Their blocking cross sections added to that of the junction 21 contribute to preventing the overspeed of the fluid which causes some of the sound noise in the heat exchangers.

The description above is in no way limited to face-to-face flow disturbers with their ends in contact. It is of course recalled that the latter may not be in contact, be placed along different axes or be placed only on one, the other or both plates 4 or 5 forming the tube 1. The combination of positioning and/or shape characteristics of the elements forming the blocking means 12 depends on the requirements concerning heat exchange and concerning reduction in sound noise. The blocking means 12 is of course applicable to a heat exchanger tube having a general U shape, but it is easy to apply this blocking means to I-shaped plates or to any other circulation duct shapes. The tube defined above is particularly suitable for radiators and an evaporator of an air-conditioning installation of an automobile.

What is claimed is:

1. A tube (1) for a heat exchanger (2) through which a fluid (3) flows, intended to promote heat exchange between an external medium (7) and said fluid, formed by at least two plates (4, 5) connected to each other in order to define a circulation duct (10), the cross section of which is a cross section (11) for passage of said fluid, said circulation duct having a fluid inlet orifice (13) and a fluid outlet orifice (14), wherein said tube comprises a means (12) for partially blocking the circulation duct (10) to keep the passage cross section (11) of said duct substantially constant between the inlet orifice (13) and the outlet orifice (14) and wherein the partial blocking means (12) is defined by the staggered positioning of flow disturbers (15, 15*a*, 16, 16*a*) each with respect to the others such that their cumulated blocking cross sections are substantially constant over the entire length of the circulation duct (10).

2. The heat exchanger tube (1) as claimed in claim 1, wherein said tube has the general shape of a "U" comprising a base (26) connected to two arms (24, 25), said arms being separated by a rib (20), the end of which is terminated by a junction (21), the passage cross section (11) to be kept constant being any one of those which lie between the rib (20) and a peripheral edge (8) of the U-shaped tube and passing through the partial blocking means (12).

3. The heat exchanger tube (1) as claimed in claim 2, wherein the shape of the junction (21) is circular with a diameter greater than twice the width of the rib (20).

4. The heat exchanger tube (1) as claimed in claim 3, wherein the peripheral edge (8) has connection regions (22, 23) connecting the two arms (24, 25) at the base (26) of the U-shaped tube, said regions being of circular shape and of a radius enabling the passage cross section (11) to be kept constant.

5. The heat exchanger tube (1) as claimed in claim 1, wherein the passage cross section (11) is constant when the difference between a minimum passage cross section and a maximum passage cross section determined in the circulation duct (10) does not exceed 20 percent.

6. The heat exchanger tube (1) as claimed in claimed 2, wherein the partial blocking means (12) is defined by the shape of flow disturbers (15, 15*a*, 16, 16*a*) each with respect to the others in the circulation duct.

7. The heat exchanger tube (1) as claimed in claim 6, wherein the flow disturbers (15, 15*a*, 16, 16*a*) are placed on at least one of the plates (4) or (5).

8. The heat exchanger tube (1) as claimed in claim 7, wherein the flow disturbers (15, 15*a*, 16, 16*a*) are placed on at least one of the plates (4) or (5) such that the direction of the axis (19) supporting their largest dimensions is substantially parallel to the circulation direction of the fluid.

9. The heat exchanger tube (1) as claimed in claim 5, wherein the flow disturbers are present on both plates (4, 5).

10. The heat exchanger tube (1) as claimed in claim 9, wherein at least one flow disturber (15) of one of the plates is placed facing at least one flow disturber (15*a*) of the other plate.

11. The heat exchanger tube (1) as claimed in claim 10, wherein the flow disturbers (15, 15*a*) of each plate are placed facing each other, the directions of their axes (18, 19) supporting their largest dimensions being substantially parallel to each other.

12. The heat exchanger tube (I) as claimed in claim 1, wherein the flow disturbers (15, 15*a*, 16, 16*a*) have an oval shape.

13. The heat exchanger tube (1) as claimed in claim 12, wherein the flow disturbers (15, 15*a*, 16, 16*a*) have a substantially circular shape.

14. The heat exchanger tube (1) as claimed in claim 1, wherein the flow disturbers (15, 15*a*, 16, 16*a*) are diamond-shaped.

15. The heat exchanger tube (1) as claimed in claim 14, wherein the flow disturbers (15, 15*a*, 16, 16*a*) have the shape of a diamond with rounded angles.

16. The heat exchanger tube (1) as claimed in claim 1, wherein the flow disturbers (15, 15*a*, 16, 16*a*) have a pyramid shape, the base of the pyramid shape being common with one of the plates (4, 5).

17. A heat exchanger which comprises at least one tube (1) defined as claimed in claim 1.

18. The heat exchanger as claimed in claim 1, wherein it is a radiator.

19. The heat exchanger as claimed in claim 1, wherein it is an evaporator.

20. A tube (1) for a heat exchanger (2) through which a fluid (3) flows, intended to promote heat exchange between an external medium (7) and said fluid, formed by at least two plates (4, 5) connected to each other in order to define a circulation duct (10), the cross section of which is a cross section (11) for passage of said fluid, said circulation duot having a fluid inlet orifice (13) and a fluid outlet orifice (14), wherein said tube comprises a means (12) for partially blocking the circulation duct (10) to keep the passage cross section (11) of said duct substantially constant between the inlet orifice (13) and the outlet orifice (14), wherein the partial blocking means (12) is defined by the shape of flow disturbers (15, 15*a*, 16, 16*a*) placed on both plates (4, 5) and wherein the plates (4, 5) are securely attached by the flow disturbers (15, 15*a*, 16, 16*a*).

21. The heat exchanger tube (1) as in claim 20, wherein the partial blocking means (12) is defined by the staggered positioning of flow disturbers (15, 15*a*, 16, 16*a*) each with respect to the others such that their cumulated blocking cross sections are substantially constant over the entire length of the circulation duct (10), end wherein the flow disturbers are present on both plates and the plates (4, 5) and are securely attached by the flow disturbers (15, 15*a*, 16, 16*a*).

22. The heat exchanger tube (1) as in claim 20, wherein the passage cross section (11) is constant when the difference between a minimum passage cross section and a maximum passage cross section determined in the circulation duct (10) does not exceed 20 percent, and wherein the flow disturbers are present on both plates (4, 5) and are securely attached by the flow disturbers (15, 15*a*, 16, 16*a*).

23. The heat exchanger tube (1) as in claim 20, wherein the partial blocking means (12) is defined by the shape of flow disturbers (15, 15*a*, 16, 16*a*) each with respect to the others in the circulation duct and wherein the flow disturbers are present on both plates (4, 5) and are securely attached by the flow disturbers (15, 15*a*, 16, 16*a*).

24. The heat exchanger tube (1) as claimed in claim 20, wherein the flow disturbers (15, 15*a*, 16, 16*a*) are placed on at least one of the plates (4) or (5) such that the direction of the axis (19) supporting their largest dimensions is substantially parallel to the circulation direction of the fluid and wherein the flow disturbers are present on both plates (4, 5) and wherein the plates (4, 5) are securely attached by the flow disturbers (15, 15*a*, 16, 16*a*).

25. A tube for a heat exchanger fanned from at least two plates connected to each other, the interior of the tube defining a circulation duct having at least one fluid inlet orifice and at least one fluid outlet orifice, wherein the interior of the tube comprises a means for partially blocking the circulating duct through which a fluid flows, to keep the cross section of the partially blocked circulation duct substantially constant between the at least one inlet orifice and the at least one outlet orifice, wherein the means for partially blocking the circulating duct are flow disturbers and wherein the flow disturbers are positioned such that the axes of the flow disturbers are offset along a vertical axis in the circulation direction of the fluid and the passage cross section is constant.

26. A heat exchanger which comprises at least one tube (1) defined as in claim 25.

27. The heat exchange as in claim 26, wherein it is a radiator.

28. The heat exchange as in claim 26, wherein it is a evaporator.

* * * * *